US005639156A

United States Patent [19]

Broxson

[11] Patent Number: 5,639,156

[45] Date of Patent: Jun. 17, 1997

[54] ILLUMINATED READING DEVICE

[76] Inventor: Gary Broxson, 8200 Hwy. 98 W., Ste. F-180, Pensacola, Fla. 32506

[21] Appl. No.: 543,795

[22] Filed: Oct. 16, 1995

[51] Int. Cl.[6] ..... F21V 33/00

[52] U.S. Cl. ..... 362/99; 362/98; 362/156; 362/802

[58] Field of Search ..... 362/99, 155, 276, 362/802, 31, 98, 251, 252, 253, 800, 234; 206/472

[56] References Cited

U.S. PATENT DOCUMENTS

| | | | |
|---|---|---|---|
| 1,202,498 | 10/1916 | Findley | 362/99 |
| 2,377,538 | 6/1945 | Cohen | 362/99 |
| 3,885,145 | 5/1975 | Wise | 362/99 |
| 4,363,081 | 12/1982 | Wilbur | 362/802 |
| 4,969,068 | 11/1990 | Williams | 362/99 |

*Primary Examiner*—Ira S. Lazarus
*Assistant Examiner*—Thomas M. Sember
*Attorney, Agent, or Firm*—George A. Bode; Michael L. Hoelter

[57] ABSTRACT

A portable illumination device for reading material in dark or underlit environments. This illumination device is operable upon the opening of its book-like folded covers and upon the tilting of the device to a pre-set angle or greater to close a circuit containing a mercury tilt switch, battery and sources of illumination. Once the device is properly positioned, the plurality of individual illumination sources are activated to illuminate the reading material placed therein. A reading bar incorporating a magnifying glass can be slid along the reading material so as to magnify or highlight such material for easier reading thereof. The tilt switch and battery power sources are preferably located along the spine of the device.

20 Claims, 5 Drawing Sheets

ILLUMINATED READING DEVICE

BACKGROUND OF THE INVENTION

1. Field of the Invention

This invention pertains to an apparatus for the illumination of reading material and, more particularly, to a battery-operated illumination apparatus that illuminates a reading surface when a selected degree of tilt is reached.

2. General Background

Many devices exist that can be used to illuminate reading material. Some of these devices consist of book holders or covers that illuminate the reading material placed therein. Typical examples of these types of devices include U.S. Pat. No. 3,364,344 issued to Marcellino, U.S. Pat. No. 3,586,847 issued to Nahmias, U.S. Pat. No. 3,823,312 issued to Weinstein, and U.S. Pat. No. 3,885,145 issued to Wise. In all of these devices, a book is placed within the cover or holder and is illuminated by turning an attached lamp either on or off. Some of these lamps are battery operated while others rely upon alternating current for their energy source. Unfortunately, these devices are either not easily portable or they are rather bulky in nature.

A variation of the above is shown in U.S. Pat. No. 1,202,498 issued to Findley, and U.S. Pat. No. 4,908,742 issued to Kersey. In these cases, a writing pad is permanently mounted to a closable cover that can also illuminate the pad if desired. This cover further incorporates a storage area for the storage of notes or even a transistor radio.

Other simpler illumination devices do not involve a cover or the like, but instead consist of a portable lamp that can be easily moved from book to book as needed. Such devices are shown in U.S. Pat. No. 2,561,744 issued to Langdon, et al., and U.S. Pat. No. 4,432,042 issued to Zeller. In each of these cases, a battery-operated lamp assembly is mounted to an upper part of the book so as to shine down on the reading material at an angle preferred by the reader. Such devices may be clipped to a number of pages of the book or may be attached to the book cover for greater support. Unfortunately, such lamps provide uneven illumination from top to bottom and side to side since all the light is emitted from a single upper source that is generally located at a mid-page position.

Still another device that assists in the reading of material is shown in U.S. Pat. No. 2,169,786 issued to Baum. In accordance with this invention, a magnifying glass is mounted on a stand that can be moved across the reading material or vice versus. It is particularly adapted for use in reading road maps and the like by drivers and/or tourists. A lamp mounted in the stand provides illumination if such is desired.

It is thus an object of this invention to provide a means of illuminating reading material such that the illumination is provided from a plurality of sources so as to insure more complete and even illumination.

Yet another object of this invention is to provide such a device that is battery operated so that it is easily portable.

Still another object of this invention is to provide an electric circuit connected to all of the illumination sources so that they all operate in unison.

A further object of this invention is to provide automatic operating means that automatically activate the illumination sources without the need for manual switches or the like.

Yet another object of this invention is to provide operating means that automatically activate the illumination sources upon the tilting of the reading material to a certain pre-set angle. Such operating means will also de-activate such illumination sources once the reading material is lowered below this pre-set angle.

Still another object of this invention is to provide a reflective backing that reflects the light back towards the reading material.

A further object of this invention is to provide a covering or housing for such reading material that may be closed as needed.

Yet another object of this invention is to provide cut-off means that interrupt the circuit to the illumination sources when the covering or housing is closed, no matter the angle or degree of tilt of the reading material.

It is still another object of this invention to be adapted for use with menus and the like so that they will be easier to read in dark or underlit areas of a restaurant.

Yet another object of this invention is to provide a reading bar that slides along the menu or other reading material to highlight or magnify such material.

These and other objects and advantages of this invention will become obvious upon further investigation.

SUMMARY OF THE PRESENT INVENTION

The preferred embodiment of the apparatus of the present invention solves the aforementioned problems in a straightforward and simple manner. This invention pertains to a portable illumination device used to illuminate reading material in dark or under-lit locations. It consists of a reading material holder that is configured having oppositely positioned covers which are connected and foldable together along a common spine region. A sheet assembly is affixed to each of these covers with this sheet assembly consisting of at least one sheet of flat transparent material. A plurality of illumination sources are secured around the perimeter of each of these sheet assemblies with these illumination sources being coupled together via circuitry to a power source mounted in the common spine region. This circuitry incorporates a tilt switch that is activated to close the circuit whenever the reading material holder is tilted above a pre-set angle. A cut-off switch in also coupled to this circuitry to open the circuitry whenever the covers of the reading material holder are folded together. Also, a clip assembly is secured to the sheet assembly for securing the reading material to the flat transparent material.

BRIEF DESCRIPTION OF THE DRAWING

For a further understanding of the nature and objects of the present invention, reference should be had to the following description taken in conjunction with the accompanying drawing in which like parts are given like reference numerals and, wherein.

DETAILED DESCRIPTION OF THE PREFERRED EMBODIMENT

Figure 2:
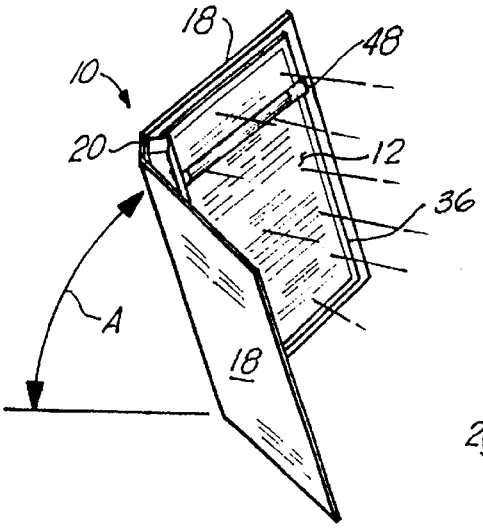
FIG. 2 is a pictorial view of the reading material holder of FIG. 1 in the open and activated position as indicated by the degree of tilt.
Figure 1:
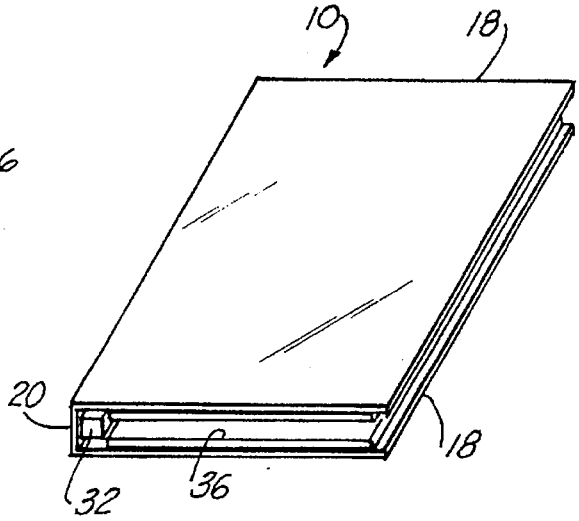
FIG. 1 is a pictorial view of the preferred embodiment of the reading material holder of the present invention in the closed or folded position.

Referring initially to FIGS. 1 and 2, there is shown reading material holder 10, which encloses reading material 12 therein. In one use, reading material 12 may be a single sheet menu of a restaurant as indicated in FIG. 2, upon the opening of reading material holder 10 and the tilting of such holder 10 above a certain pre-set angle, designated as angle A, a series of illumination sources 16 are automatically activated so as to illuminate reading material 12. Such activation will aid the user in clearly seeing reading material 12 in dark or under-lit locations.

It should here be stated that while the following description is with respect to the reading of a menu, this invention may also be used in other locations and for other purposes such as those that may involve a clip-board or a notebook. Consequently, this invention can be used in educational, industrial or business locations as well as in commercial or retail establishments. In any event, this invention can be used wherever portable illumination of reading and/or writing material is desired. It need not be limited solely to the reading of menus in restaurants.

Referring now to FIGS. 3–6, there is shown a pictorial layout of the various components of holder 10. As illustrated, circuitry 14 interconnects a plurality of illumination sources 16 which are positioned about the perimeter of each of two covers 18 of book-like holder 10. These two covers 18 fold together in the normal fashion about central region or spine 20. It is within central region or spine 20 that power sources 22, such as replaceable and/or rechargeable batteries, are located.

Preferably, these various illumination sources 16 would all be strung together in series in circuitry 14. However, it may be desirable for each cover 18 to have its own respective circuitry 14 for independently interconnecting its own illumination sources 16. In any event, such illumination sources 16 may be small battery operated light bulbs or they can be very powerful light emitting diodes. Any other type of illumination source is equally likely so long as they emit sufficient light to aid the user in reading menu 12. Also, it should be understood that these illumination sources 16 can be replaced as needed should one or more of them burn out. It should also be understood that in the event one or more illumination sources 16 do burn out, this will not interrupt circuitry 14. Instead, circuitry 14 is such that the remaining illumination sources 16 will still be powered so as to emit light as needed.

Figure 5:
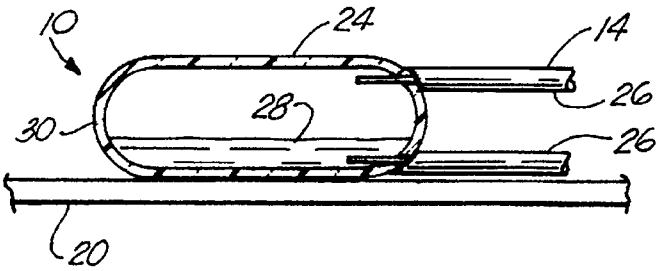
FIG. 5 is a cross-sectional view of the mercury switch of the reading material holder of FIG. 1 when in the de-activated position.
Figure 6:
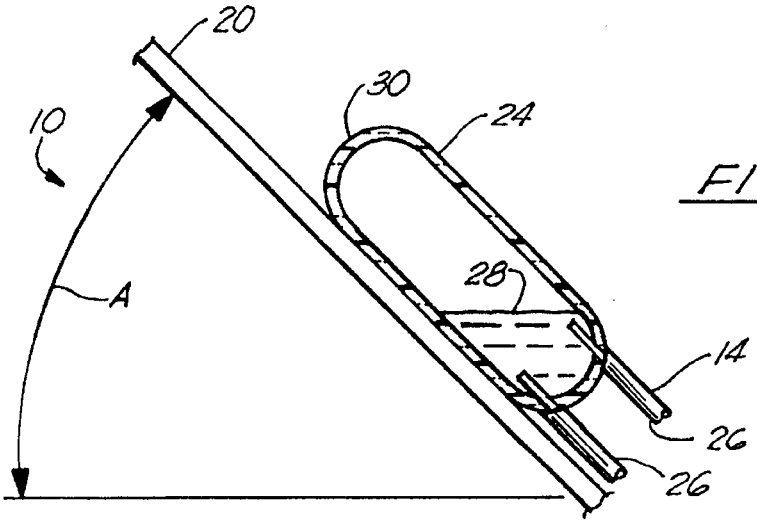
FIG. 6 is a cross-sectional view of the mercury switch of the reading material holder of FIG. 1 when tilted to the activated position.

Also located within central region or spine 20 is tilt switch 24. This tilt switch 24 is designed to close or bridge a gap between two or more exposed electrical conductors or wires 26 of circuitry 14 as shown in FIGS. 5 and 6. Such closure or bridging of wires 26 only occurs upon the tilting of holder 10 to pre-set angle A or greater as indicated in FIGS. 2 and 6. Generally, a mercury switch would be used for this since the mercury 28 contained within housing 30 (with the terminal ends of conductors 26) remains in a fluid state at room temperatures and also conducts an electric current. However, any other type or design of tilt switch 24 can be used, the important function being the ability to close an electric circuit upon the tilting of holder 10 to above a pre-set angle A or greater.

Figure 3:
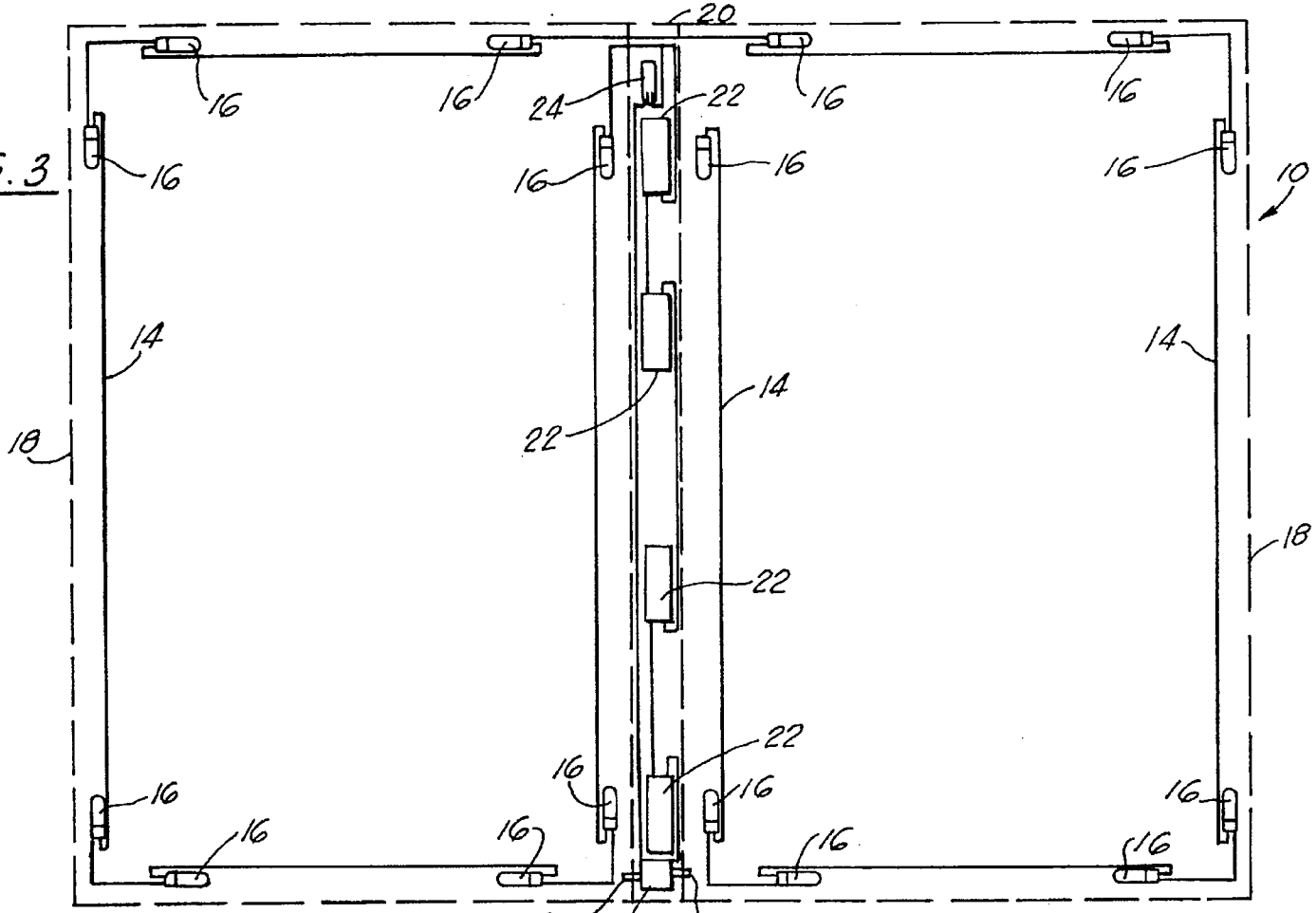
FIG. 3 is a front view of the reading material holder of FIG. 1 in the fully open position.
Figure 4:
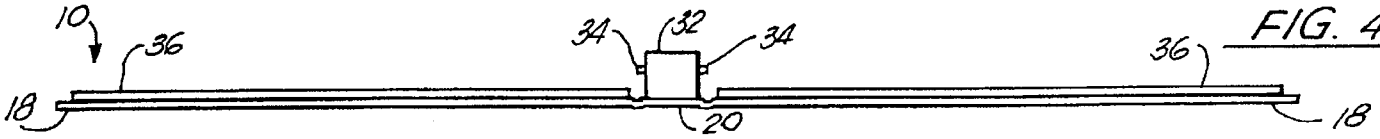
FIG. 4 is a bottom plan view of the reading material holder of FIG. 1 in the fully open position.
Figure 7:
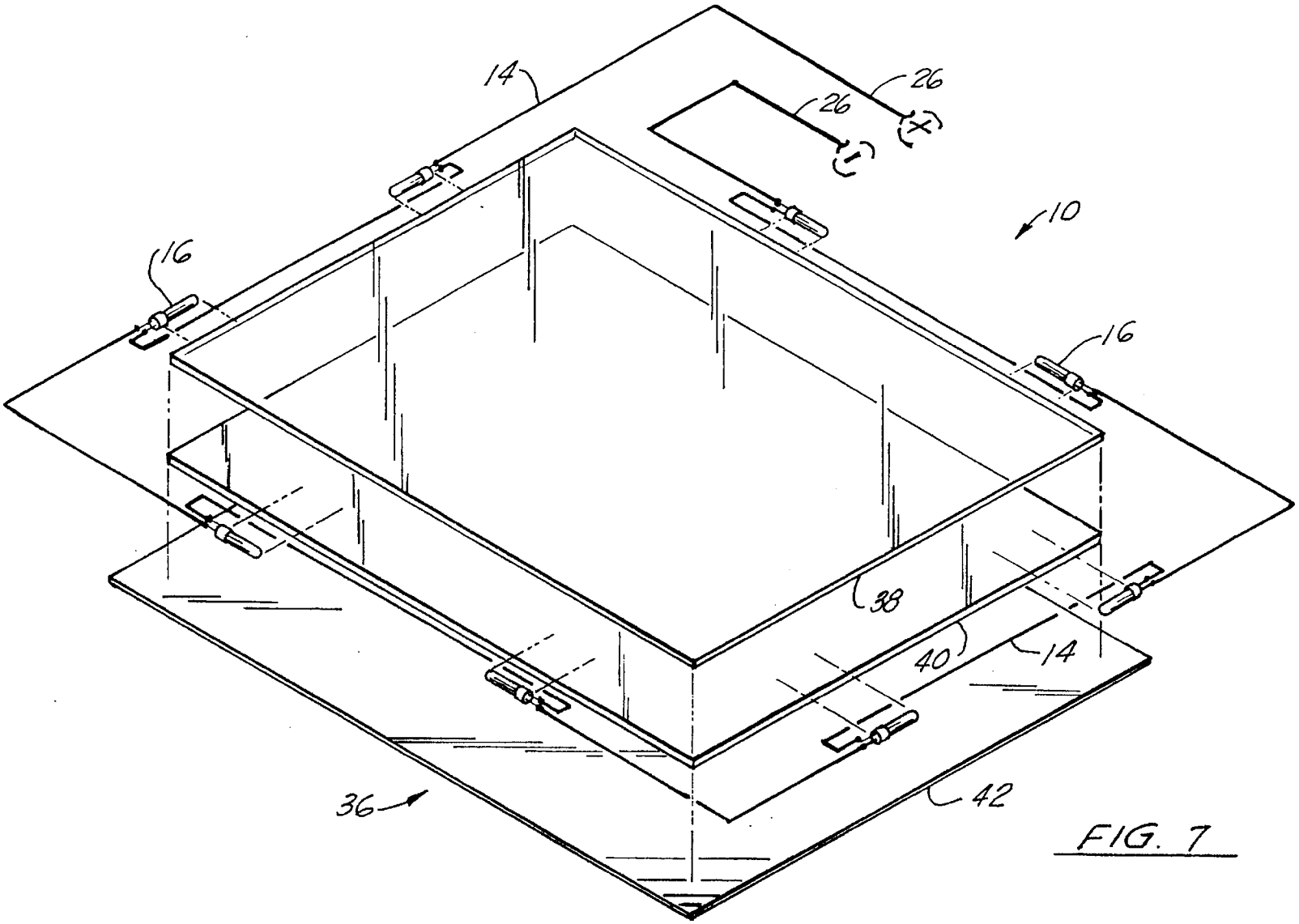
FIG. 7 is an exploded pictorial view of one side of the reading material holder of FIG. 1 illustrating the arrangement of the reflective covering, the flat opaque material, the flat transparent material, and the circuitry attached to and surrounding this arrangement.

FIGS. 3 and 4 also disclose cut-off switch 32 within central region or spine 20. This cut-off switch 32 is configured with two oppositely extending prongs 34 that are normally biased in the outward direction. Thus, when holder 10 is in the open position of FIGS. 3 and 4, prongs 34 are at their full extension resulting in cut-off switch 32 bridging or closing a gap in circuitry 14. This permits illumination sources 16 to be powered by power sources 22 upon the tilting of holder 10 to preset angle A or greater. However, when covers 18 of holder 10 are folded together or to the closed position of FIG. 1, they engage each of prongs 34, thereby causing them to recede or be pushed into cut-off switch 32. This activates cut-off switch 32, thereby opening or causing a break in circuitry 14. When this occurs, illumination sources 16 are no longer powered by power sources 22 no matter how great the tilt or angle of holder 10. Consequently, the only way illumination sources 16 can be powered is if holder 10 is both tilted to pre-set angle A or greater and covers 18 are open so that prongs 34 fully extend outwardly. Should one or the other not occur, then either tilt switch 24 or cut-off switch 32 will cause a break in circuitry 14.

Figure 8:
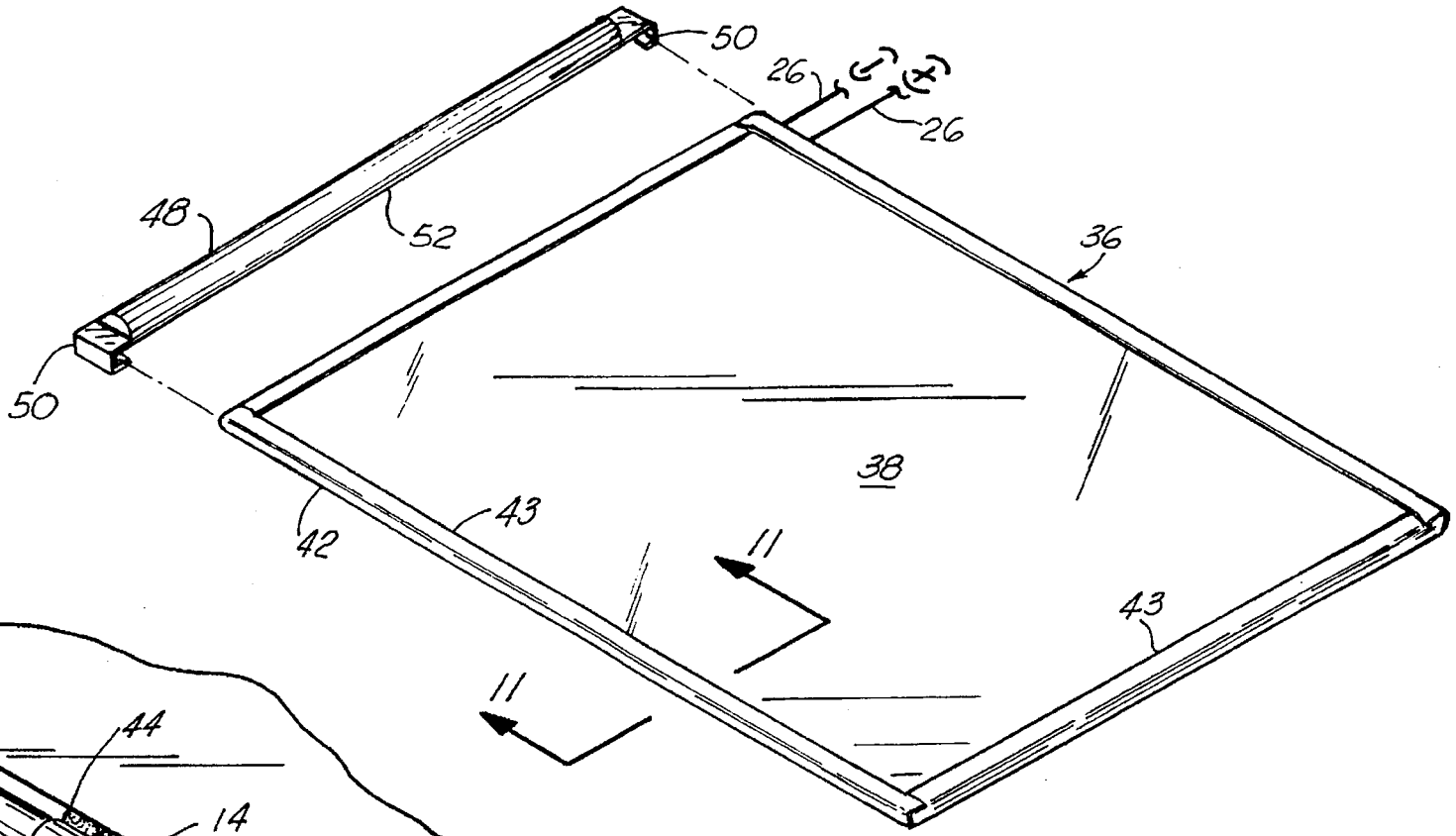
FIG. 8 is a pictorial view of the assembly illustrated in FIG. 7 with the edges of the reflective coating being wrapped around the edges of both the opaque and transparent material and covering the illumination sources and related circuitry.
Figure 9:
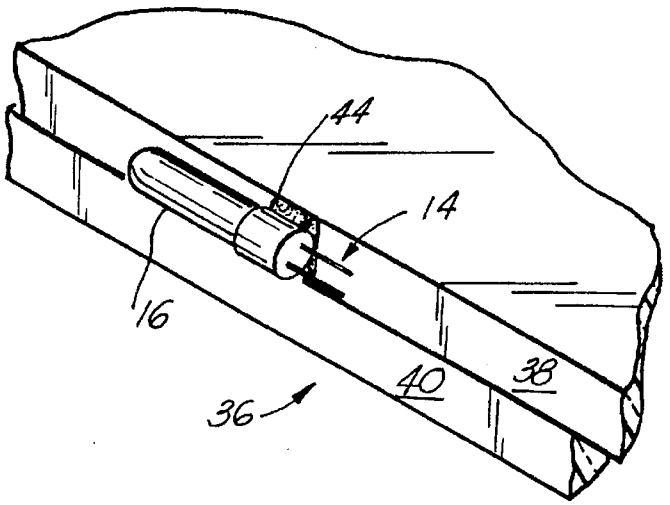
FIG. 9 is a pictorial view, partially cut away, of the manner of attachment of the illumination sources to the transparent material.
Figure 10:
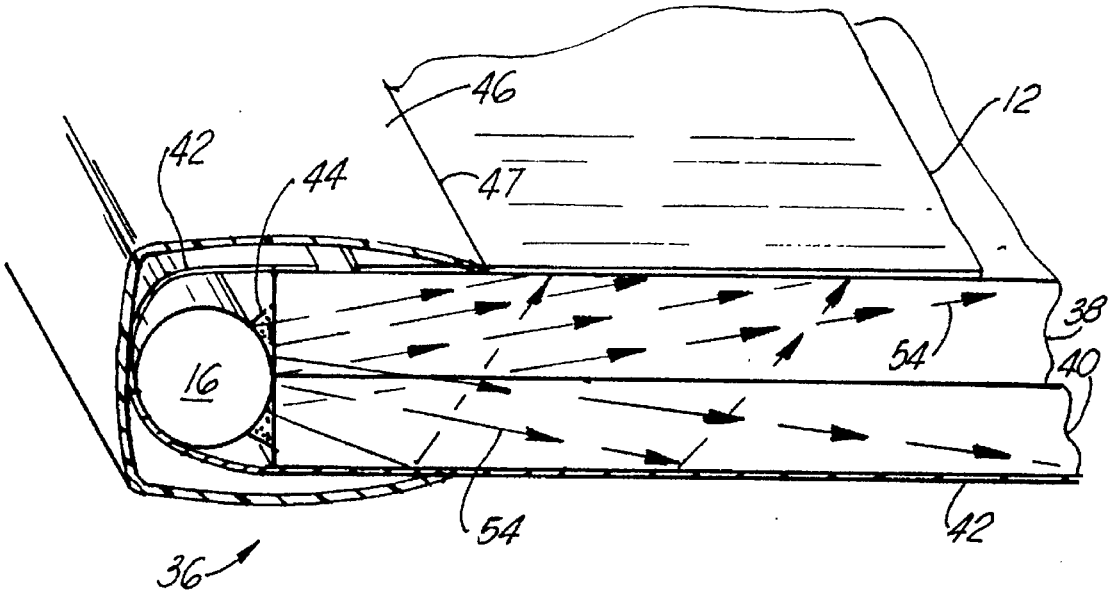
FIG. 10 is a pictorial view depicting the operation of the invention by illustrating the manner of illuminating the reading material; and, FIG. 11 is a cross-sectional view taken along lines 11—11 of FIG. 8 illustrating the clamp further covering the illumination source and retaining the reading material in place.

Referring now to FIGS. 7–11, there is shown sheet assembly 36 which would be secured to the inner side of each of covers 18 of holder 10 in the normal fashion. Each sheet assembly 36 consists of an upper sheet of flat transparent material 38, an intermediate sheet of opaque material 40, and a bottom sheet of reflective film 42. Illumination sources 16 are secured about the perimeter of sheet assembly 36 such as by a piece of tape, glue, or other normal means of attachment 44. Circuitry 14 would also be installed to connect these various illumination sources 16 together. Once thus assembled, reflective film 42, which is larger in size than transparent and opaque sheets 38 and 40, would have its edges 43 folded up as shown in FIG. 8, thereby covering the edges of both such sheets as well as each illumination source 16. In this fashion, both circuitry 14 and illumination sources 16 are protected and the light from each of these illumination sources 16 will be directed inwardly into sheet assembly 36. Bottom reflective film 42 will act as shown in FIG. 10 to reflect any such light upwardly toward and within sheet assembly 36.

Figure 11:
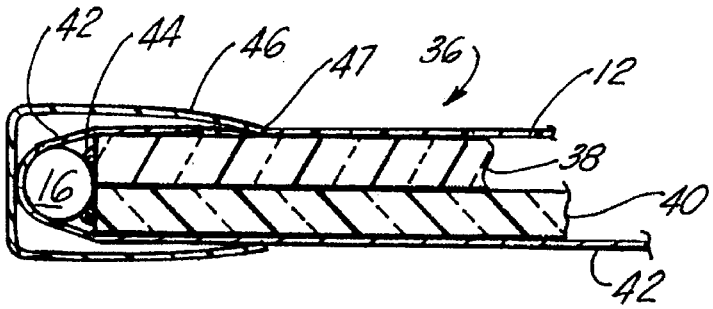

Before being installed upon covers 18 of holder 10 in the normal fashion, this sheet assembly 36 would again have its perimeter edges enclosed within a second protective clip 46 (see FIGS. 10 and 11). This clip 46 would surround the folded-up edge of reflective film 42, thereby also surrounding illumination sources 16. This provides additional protection for such devices and will prevent them from breaking. Furthermore, clip 46 is designed to be flexible enough to enable menu 12 to be slid underneath one of its elongated edges 47 as shown in FIGS. 10 and 11.

Preferably, clip 46 would be made of a somewhat rigid plastic or nylon material, but it could also be made of a metal, such as aluminum, or of rubber. Clip 46 would also have a natural tendency to compress or push against both sides of sheet assembly 36 so as to retain itself in place and to hold menu 12 wherever it is inserted.

Also disclosed is reading bar 48 (best seen in FIGS. 1 and 8) which slides up and down sheet assembly 36 atop menu 12. Reading bar 48 would normally have its end regions 50 turned under in a "C" clamp shape as shown so as to freely slide alongside clip 46 yet be retained on assembly 36. Intermediate such end regions 52 would typically be magnifying glass 52 which would assist the user in reading menu 12 if such is desired. In other embodiments, reading bar 48 could merely contain a length of colored material instead of magnifying glass 52 so as to simply highlight different portions of menu 12 rather than magnify them. In any event, reading bar 48 is moved up and down sheet assembly 36 as needed by the user.

Referring now to FIG. 10, the operation of menu-holder 10 is illustrated. Upon the activation of illumination sources 16 by opening holder 10 and tilting it to angle A or greater, light is generated by sources 16 that is reflected into sheet assembly 36 as indicated by ARROWS 54. This light travels and is reflected within sheet assembly 36 to illuminate or backlight menu 12. Of course, for best operation, menu 12 would be constructed of thin relatively transparent material so that such light can pass through menu 12. In other embodiments, menu 12 may consist of a cut-out stencil through whose openings such light passes. In any event, the backlighting provided by illumination sources 16 highlights the differences between the words written upon menu 12 and the blank spaces or areas where nothing is written. This contrast between the two makes it easier for menu 12 to be read. Also, if need be, reading bar 48 can be moved or slid into position for greater ease in the reading of menu 12.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A portable illumination device for the illumination of reading material placed thereon comprising:

(a) a reading material holder having oppositely positioned covers that are connected and foldable together along a common spine region;

(b) a sheet assembly affixed to each of said covers, said sheet assembly comprising at least one sheet of flat transparent material;

(c) a plurality of illumination sources secured around a perimeter of each of said sheet assemblies, said illumination sources coupled via circuitry to a power source mounted in said common spine region;

(d) a first switch provided in said circuitry that is activated to close said circuitry whenever said reading material holder is tilted to a pre-set angle or greater angle;

(e) a second switch in said circuitry that is activated to open said circuitry whenever said covers are folded together; and, (f) means secured to said sheet assembly for securing said reading material to said flat transparent material.

2. The illumination device as set forth in claim 1, wherein said sheet assembly further comprises a second sheet of flat opaque material mounted underneath said sheet of transparent material.

3. The illumination device as set forth in claim 2, further comprising a reflective film that covers a bottom of said second sheet and having marginal edges folded over sides of said sheet assembly, said reflective film further surrounding said plurality of illumination sources secured around the perimeter of each said sheet assembly.

4. The illumination device as set forth in claim 3, wherein said illumination sources are serially connected.

5. The illumination device as set forth in claim 4, wherein said first switch is located in said common spine region.

6. The illumination device as set forth in claim 5, wherein said first switch comprises a mercury tilt switch.

7. The illumination device as set forth in claim 6, wherein said second switch is located in said common spine region.

8. The illumination device as set forth in claim 7, wherein said means for securing extend around the perimeter of each of said sheet assemblies.

9. The illumination device as set forth in claim 8, wherein said means for securing further surround said illumination sources and said marginal edges of said reflective film.

10. The illumination device as set forth in claim 9, further comprising a reading bar slidable along said sheet assembly and upon said means for securing, said reading bar comprising a magnifying means therein for the magnification of said reading material.

11. A method of portably illuminating reading material comprising the steps of:

(a) constructing and arranging a reading material holder having oppositely positioned covers that are foldable together along a common spine region;

(b) affixing a sheet assembly to each said cover, said sheet assembly comprising at least one sheet of flat transparent material;

(c) securing a plurality of illumination sources around a perimeter of each said sheet assembly, said illumination sources coupled via circuitry to a power source mounted in said common spine region;

(d) activating a tilt switch in said circuitry to close said circuitry whenever said reading material holder is tilted to a pre-set angle or greater;

(e) activating a cut-off switch in said circuitry to open said circuitry whenever said covers are folded together; and, (f) securing said reading material to said flat transparent material.

12. The method as set forth in claim 11, further comprising the step of constructing and arranging said sheet assembly with a second sheet of flat opaque material mounted underneath said sheet of transparent material.

13. The method as set forth in claim 12, further comprising the step of covering a bottom of said second sheet with a reflective film and folding marginal edges of said reflective film around sides of said sheet assembly, said reflective film further surrounding said plurality of illumination sources secured around the perimeter of each said sheet assembly.

14. The method as set forth in claim 13, further comprising the step of serially connecting said illumination sources.

15. The method as set forth in claim 14, further comprising the step of locating said tilt switch in said common spine region.

16. The method as set forth in claim 15, wherein said tilt switch is a mercury tilt switch.

17. The method as set forth in claim 16, wherein said cut-off switch is positioned in said common spine region.

18. The method as set forth in claim 17, wherein means are provided around the perimeter of each said sheet assembly to secure said reading material to said flat transparent material.

19. The method as set forth in claim 18, further comprising the step of surrounding said illumination sources and said edges of said reflective film with said means for securing.

20. The method as set forth in claim 19, further comprising the step of sliding a reading bar along said sheet assembly and upon said means for securing, said reading bar comprising a magnifying means for magnification of said reading material.

* * * * *